US011333405B2

(12) United States Patent
Oyama

(10) Patent No.: US 11,333,405 B2
(45) Date of Patent: May 17, 2022

(54) CRYOCOOLER

(71) Applicant: SUMITOMO HEAVY INDUSTRIES, LTD., Tokyo (JP)

(72) Inventor: Shuji Oyama, Nishitokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 50 days.

(21) Appl. No.: 16/996,897

(22) Filed: Aug. 19, 2020

(65) Prior Publication Data

US 2020/0378653 A1 Dec. 3, 2020

Related U.S. Application Data

(63) Continuation of application No. PCT/JP2019/006007, filed on Feb. 19, 2019.

(30) Foreign Application Priority Data

Feb. 20, 2018 (JP) ..... JP2018-028031

(51) Int. Cl.

| | |
|---|---|
| ***F25B 9/14*** | (2006.01) |
| ***F25B 9/06*** | (2006.01) |
| *F25B 49/02* | (2006.01) |
| *F25B 49/00* | (2006.01) |

(52) U.S. Cl.

CPC ..... *F25B 9/065* (2013.01); *F25B 9/145* (2013.01); *F25B 49/00* (2013.01); *F25B 49/022* (2013.01); *F25B 2309/1408* (2013.01); *F25B 2309/1418* (2013.01); *F25B 2600/25* (2013.01)

(58) Field of Classification Search

CPC ..... F25B 49/022; F25B 2309/1418; F25B 2600/25; F25B 49/00

See application file for complete search history.

(56) References Cited

U.S. PATENT DOCUMENTS

| | | | |
|---|---|---|---|
| 9,546,647 | B2 | 1/2017 | Longsworth |
| 9,759,467 | B2 | 9/2017 | Kimura |

FOREIGN PATENT DOCUMENTS

| | | | | |
|---|---|---|---|---|
| CN | 201548001 | U | | 8/2010 |
| CN | 204115161 | U | | 1/2015 |
| CN | 106595126 | A | | 4/2017 |
| JP | S5314447 | A | | 2/1978 |
| JP | S54181359 | U | | 12/1979 |
| JP | H0252061 | U | | 4/1990 |
| JP | 2004085048 | A | * | 3/2004 |

(Continued)

*Primary Examiner* — Lionel Nouketcha
(74) *Attorney, Agent, or Firm* — HEA Law PLLC

(57) ABSTRACT

A cryocooler includes a compressor, an expander, a gas line that allows a working gas to be circulated between the compressor and the expander and includes a high pressure line through which the working gas is supplied from the compressor to the expander and a low pressure line through which the working gas is collected from the expander to the compressor, a bypass line that connects the high pressure line to the low pressure line such that the working gas bypasses the expander and returns from the high pressure line to the low pressure line, and a bypass flow rate control unit that controls a flow rate of the working gas flowing in the bypass line to provide pressure control of the gas line. The bypass line includes a variable flow rate bypass and a fixed flow rate bypass.

9 Claims, 8 Drawing Sheets

(56) References Cited

FOREIGN PATENT DOCUMENTS

| | | | |
|---|---|---|---|
| JP | 2004085048 | A | 3/2004 |
| JP | 2011005091 | A | 1/2011 |
| JP | 2011141074 | A | 7/2011 |
| JP | 2013134020 | A | 7/2013 |
| JP | 2014523994 | A | 9/2014 |

* cited by examiner

CRYOCOOLER

RELATED APPLICATIONS

The contents of Japanese Patent Application No. 2018-028031, and of International Patent Application No. PCT/JP2019/006007, on the basis of each of which priority benefits are claimed in an accompanying application data sheet, are in their entirety incorporated herein by reference.

BACKGROUND

Technical Field

A certain embodiment of the present invention relates to a cryocooler.

Description of Related Art

A cryocooler including a compressor and an expander, which is also called a cold head, is known in the related art. The compressor compresses a working gas of the cryocooler at a high pressure and supplies the working gas to the expander. The working gas is expanded by the expander to generate cold. The expansion reduces a pressure of the working gas. The low-pressure working gas is collected in the compressor and is compressed again.

SUMMARY

According to an embodiment of the present invention, there is provided a cryocooler including a compressor, an expander, a gas line that allows a working gas to be circulated between the compressor and the expander and includes a high pressure line through which the working gas is supplied from the compressor to the expander and a low pressure line through which the working gas is collected from the expander to the compressor, a bypass line that connects the high pressure line to the low pressure line such that the working gas bypasses the expander and returns from the high pressure line to the low pressure line, and a bypass flow rate control unit that controls a flow rate of the working gas flowing in the bypass line to provide pressure control of the gas line. The bypass line includes a variable flow rate bypass that includes a flow rate control valve and connects the high pressure line to the low pressure line and a fixed flow rate bypass that includes an on/off valve and connects the high pressure line to the low pressure line in parallel with the variable flow rate bypass. The bypass flow rate control unit controls the flow rate of the working gas flowing in the bypass line through a combination of opening degree adjustment of the flow rate control valve and switching of the on/off valve.

Any combination of the components described above and a combination obtained by switching the components and expressions of the present invention between methods, devices, and systems are also effective as an aspect of the present invention.

DETAILED DESCRIPTION

A pressure of a working gas supplied from a compressor to an expander or a differential pressure between a high-pressure working gas and a low-pressure working gas collected from the expander to the compressor affects a cooling capacity of a cryocooler. Thus, the cryocooler may have a flow rate adjusting device for performing suitable pressure control such as maintaining a high pressure or a differential pressure at an appropriate value and controlling the high pressure or the differential pressure to a desired value.

It is desirable to provide a technique of suppressing an increase in size of a flow rate adjusting device that can be used in a relatively large cryocooler.

Hereinafter, embodiments for carrying out the present invention will be described in detail with reference to the drawings. In the description and drawings, the same or equivalent components, members, and processes will be assigned with the same reference signs, and redundant description will be omitted as appropriate. The scales and shapes of the illustrated parts are set for convenience in order to make the description easy to understand, and are not to be understood as limiting unless stated otherwise. The embodiments are merely examples and do not limit the scope of the present invention. All characteristics and combinations to be described in the embodiments are not necessarily essential to the invention.

Figure 1:
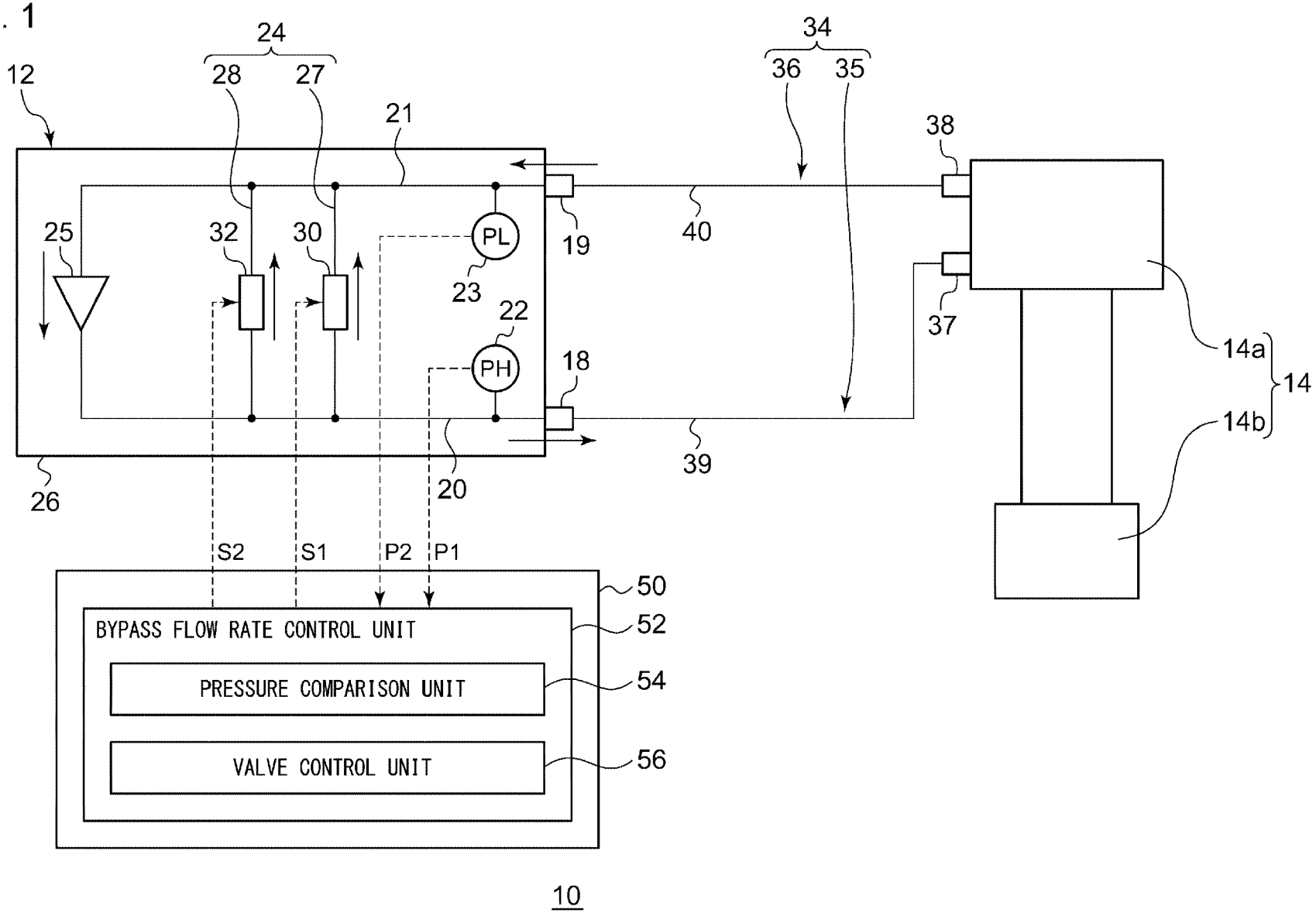
FIG. 1 is a diagram schematically showing a cryocooler according to one embodiment.

FIG. 1 is a diagram schematically showing a cryocooler 10 according to one embodiment.

The cryocooler 10 includes a compressor 12 and an expander 14. The compressor 12 is configured to collect a working gas of the cryocooler 10 from the expander 14, to pressurize the collected working gas, and to supply the working gas to the expander 14 again. The expander 14 is also called a cold head and has a room temperature section 14*a* and a low-temperature section 14*b* which is also called a cooling stage. The compressor 12 and the expander 14 configure a refrigeration cycle of the cryocooler 10, and thereby the low-temperature section 14*b* is cooled to a desired cryogenic temperature. The working gas is also called a refrigerant gas, and other suitable gases may be used although a helium gas is typically used. To facilitate understanding, a direction in which the working gas flows is shown with an arrow in FIG. 1.

Although the cryocooler 10 is, for example, a single-stage or two-stage Gifford-McMahon (GM) cryocooler, the cryocooler may be a pulse tube cryocooler, a Sterling cryocooler, or other types of cryocoolers. Although the expander 14 has a different configuration depending on the type of the cryocooler 10, the compressor 12 can use the configuration described below regardless of the type of the cryocooler 10.

In general, both of a pressure of the working gas to be supplied from the compressor 12 to the expander 14 and a pressure of the working gas to be collected from the expander 14 to the compressor 12 are considerably higher than the atmospheric pressure, and can be called a first high pressure and a second high pressure, respectively. For convenience of description, the first high pressure and the second high pressure will also be simply referred to as a high pressure and a low pressure, respectively. Typically, the high pressure is, for example, 2 to 3 MPa. The low pressure is, for example, 0.5 to 1.5 MPa, and is, for example, approximately 0.8 MPa.

The compressor 12 includes a high pressure gas outlet 18, a low pressure gas inlet 19, a high pressure flow path 20, a low pressure flow path 21, a first pressure sensor 22, a second pressure sensor 23, a bypass line 24, a compressor main body 25, and a compressor casing 26. The high pressure gas outlet 18 is provided in the compressor casing 26 as a working gas discharge port of the compressor 12, and the low pressure gas inlet 19 is provided in the compressor casing 26 as a working gas intake port of the compressor 12. The high pressure flow path 20 connects a discharge port of the compressor main body 25 to the high pressure gas outlet 18, and the low pressure flow path 21 connects the low pressure gas inlet 19 to an intake port of the compressor main body 25. The compressor casing 26 accommodates the high pressure flow path 20, the low pressure flow path 21, the first pressure sensor 22, the second pressure sensor 23, the bypass line 24, and the compressor main body 25. The compressor 12 is also called a compressor unit.

The compressor main body 25 is configured to internally compress the working gas taken in from the intake port and to discharge the working gas from the discharge port. The compressor main body 25 may be, for example, a scroll type pump, a rotary type pump, or other pumps that pressurize the working gas. The compressor main body 25 may be configured to discharge the working gas at a fixed and constant flow rate. Alternatively, the compressor main body 25 may be configured to change the flow rate of the working gas to be discharged. The compressor main body 25 is called a compression capsule in some cases.

The first pressure sensor 22 is disposed in the high pressure flow path 20 to measure the pressure of the working gas flowing in the high pressure flow path 20. The first pressure sensor 22 is configured to output a first measured pressure signal P1 indicating the measured pressure. The second pressure sensor 23 is disposed in the low pressure flow path 21 to measure the pressure of the working gas flowing in the low pressure flow path 21. The second pressure sensor 23 is configured to output a second measured pressure signal P2 indicating the measured pressure. Accordingly, the first pressure sensor 22 and the second pressure sensor 23 can also be called a high pressure sensor and a low pressure sensor, respectively. In addition, in the specification, any one of the first pressure sensor 22 and the second pressure sensor 23 or both of the first pressure sensor and the second pressure sensor will be collectively and simply referred to as a "pressure sensor" in some cases.

The bypass line 24 connects the high pressure flow path 20 to the low pressure flow path 21 such that the working gas bypasses the expander 14 and returns from the high pressure flow path 20 to the low pressure flow path 21. The bypass line 24 includes a variable flow rate bypass 27 that connects the high pressure flow path 20 to the low pressure flow path 21 and a fixed flow rate bypass 28 that connects the high pressure flow path 20 to the low pressure flow path 21 in parallel with the variable flow rate bypass 27.

The variable flow rate bypass 27 includes a flow rate control valve 30 which is an example of a flow rate adjusting device. The flow rate control valve 30 is disposed in the variable flow rate bypass 27 to control the flow rate of the working gas flowing in the variable flow rate bypass 27. The flow rate control valve 30 is configured to operate in accordance with an opening degree instruction signal S1. The opening degree instruction signal S1 is a control signal or other electric signals that indicate an opening degree (%) that the flow rate control valve 30 is to take. When the opening degree of the flow rate control valve 30 increases, the flow rate of the working gas in the variable flow rate bypass 27 increases, and when the opening degree of the flow rate control valve 30 decreases, the flow rate of the working gas in the variable flow rate bypass 27 decreases. When the flow rate control valve 30 has an opening degree of 100%, the flow rate control valve 30 is fully opened, and the working gas flows in the variable flow rate bypass 27 at a maximum flow rate. When the flow rate control valve 30 has an opening degree of 0%, the flow rate control valve 30 is fully closed, and the working gas does not flow in the variable flow rate bypass 27. By changing the opening degree of the flow rate control valve 30, the flow rate of the working gas flowing in the variable flow rate bypass 27 can be controlled continuously or stepwise.

The flow rate control valve 30 is, for example, an electric valve, that is, a valve driven by an electric motor. The electric valve is configured such that an opening degree can be controlled in accordance with the opening degree instruction signal S1. The opening degree instruction signal S1 may be a drive current or a drive voltage to be input to the electric valve (electric motor) to control the opening degree of the electric valve.

The fixed flow rate bypass 28 includes an on/off valve 32 which is an example of the flow rate adjusting device. The on/off valve 32 is disposed in the fixed flow rate bypass 28 to control the flow rate of the working gas flowing in the fixed flow rate bypass 28. The on/off valve 32 is configured to operate in accordance with an on/off instruction signal S2. The on/off instruction signal S2 is a control signal or other electric signals that indicate an on/off state (that is, an open/closed state) that the on/off valve 32 is to take. When the on/off valve 32 is turned on, the on/off valve 32 is opened and the working gas flows in the fixed flow rate bypass 28. When the on/off valve 32 is turned off, the on/off valve 32 is closed, and the working gas does not flow in the fixed flow rate bypass 28. By changing the on/off state of the on/off valve 32, the flow rate of the working gas flowing in the fixed flow rate bypass 28 can be controlled in a binary manner.

The on/off valve 32 is, for example, an electromagnetic valve which is a so-called solenoid valve. The electromagnetic valve is configured such that an on/off state can be controlled in accordance with the on/off instruction signal S2. The on/off instruction signal S2 may be a drive current or a drive voltage to be input to the electromagnetic valve to control the on/off state of the electromagnetic valve.

Therefore, the flow rate of the working gas flowing in the bypass line 24 can be controlled through a combination of opening degree adjustment of the flow rate control valve 30 and the switching of the on/off valve 32. Since the flow rate control valve 30 and the on/off valve 32 are provided in parallel, the total flow rate of the bypass line 24 can be increased compared to a case where only one valve of the flow rate control valve and the on/off valve is provided in the bypass line 24. In other words, a controllable flow rate range of the bypass line 24 can be widened. In addition, it can be said that the flow rate control valve 30 is responsible for precise flow rate control of the bypass line 24, and the on/off valve 32 is responsible for approximate flow rate control of the bypass line 24.

The compressor 12 can have other various components. For example, an oil separator or an adsorber may be provided in the high pressure flow path 20. A storage tank and other components may be provided in the low pressure flow path 21. In addition, an oil circulation system that cools the compressor main body 25 with an oil and a cooling system that cools the oil may be provided in the compressor 12.

In addition, the cryocooler 10 includes a gas line 34 that circulates the working gas between the compressor 12 and the expander 14. The gas line 34 includes a high pressure line 35 through which the working gas is supplied from the compressor 12 to the expander 14 and a low pressure line 36 through which the working gas is collected from the expander 14 to the compressor 12. The room temperature section 14*a* of the expander 14 includes a high pressure gas inlet 37 and a low pressure gas outlet 38. The high pressure gas inlet 37 is connected to the high pressure gas outlet 18 by a high-pressure pipe 39, and the low pressure gas outlet 38 is connected to the low pressure gas inlet 19 by a low-pressure pipe 40. The high pressure line 35 is formed by the high-pressure pipe 39 and the high pressure flow path 20, and the low pressure line 36 is formed by the low-pressure pipe 40 and the low pressure flow path 21.

The bypass line 24 fluidly connects the high pressure line 35 to the low pressure line 36 such that the working gas bypasses the expander 14 and returns from the high pressure line 35 to the low pressure line 36. The variable flow rate bypass 27 fluidly connects the high pressure line 35 to the low pressure line 36, and the fixed flow rate bypass 28 fluidly connects the high pressure line 35 to the low pressure line 36 in parallel with the variable flow rate bypass 27.

Therefore, the working gas to be collected from the expander 14 to the compressor 12 enters the low pressure gas inlet 19 of the compressor 12 from the low pressure gas outlet 38 of the expander 14 through the low-pressure pipe 40, and further returns to the compressor main body 25 via the low pressure flow path 21 so as to be compressed and pressurized by the compressor main body 25. The working gas to be supplied from the compressor 12 to the expander 14 exits from the high pressure gas outlet 18 of the compressor 12 through the high pressure flow path 20 from the compressor main body 25, and is further supplied to the expander 14 via the high-pressure pipe 39 and the high pressure gas inlet 37 of the expander 14.

Since the high pressure flow path 20 branches into the bypass line 24, a part of the working gas flowing in the high pressure flow path 20 is diverted from the high pressure flow path 20 to the bypass line 24. The working gas flows in the bypass line 24, specifically, the variable flow rate bypass 27 and the fixed flow rate bypass 28 at a flow rate depending on the opening degree of the flow rate control valve 30 and the on/off state of the on/off valve 32. Since the bypass line 24 joins the low pressure flow path 21, the working gas bypasses the expander 14 and returns to the compressor main body 25.

The cryocooler 10 includes a control device 50 that controls the cryocooler 10. The control device 50 includes a bypass flow rate control unit 52 configured to control the flow rate of the working gas flowing in the bypass line 24. The bypass flow rate control unit 52 is configured to provide pressure control of the gas line 34 by controlling the flow rate of the working gas in the bypass line 24. The bypass flow rate control unit 52 is configured to control the flow rate of the working gas flowing in the bypass line 24 through a combination of the opening degree adjustment of the flow rate control valve 30 and the switching of the on/off valve 32.

The bypass flow rate control unit 52 includes a pressure comparison unit 54 and a valve control unit 56. The pressure comparison unit 54 is configured to compare a measured pressure of the gas line 34 with a target pressure. The valve control unit 56 is configured to control the flow rate control valve 30 and the on/off valve 32 based on a comparison result from the pressure comparison unit 54, the opening degree of the flow rate control valve 30, and the on/off state of the on/off valve 32.

The control device 50 is electrically connected to the first pressure sensor 22 and the second pressure sensor 23 to acquire the first measured pressure signal P1 and the second measured pressure signal P2. In addition, the control device 50 is electrically connected to the flow rate control valve 30 to supply the opening degree instruction signal S1 and is electrically connected to the on/off valve 32 to supply the on/off instruction signal S2.

The control device 50 is realized by an element or a circuit including a CPU and a memory of a computer as a hardware configuration and is realized by a computer program as a software configuration, but is shown in FIG. 1 as a functional block realized in cooperation therewith. It is clear for those skilled in the art that the functional blocks can be realized in various manners in combination with hardware and software.

Figure 2:
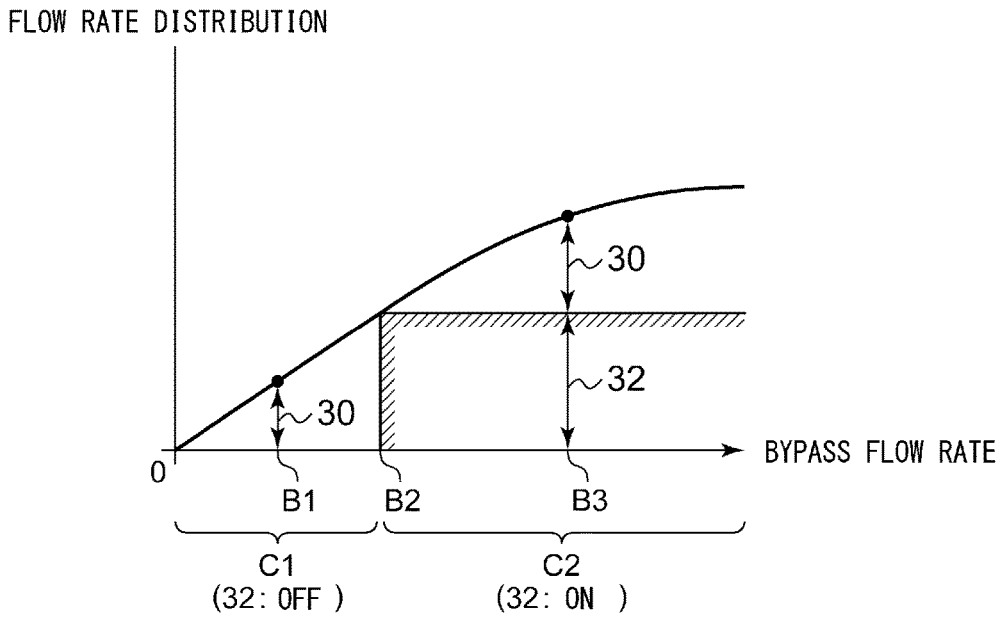
FIG. 2 is a conceptual diagram for describing flow rate distribution in a bypass line according to the one embodiment.

FIG. 2 is a conceptual diagram for describing flow rate distribution in the bypass line 24 according to the one embodiment. In a case where a desired bypass flow rate is low (a low flow rate range C1), the on/off valve 32 is turned off. In a case where the desired bypass flow rate is high (a high flow rate range C2), the on/off valve 32 is turned on. The opening degree of the flow rate control valve 30 is controlled depending on the desired bypass flow rate regardless of the level of the desired bypass flow rate.

As shown in FIG. 2, in a case where a bypass flow rate B1 included in the low flow rate range C1 is desired, the desired bypass flow rate B1 can be realized only through the opening degree adjustment of the flow rate control valve 30. In this case, only the variable flow rate bypass 27 is used and the fixed flow rate bypass 28 is not used.

In a case where a bypass flow rate B2, which is a boundary between the low flow rate range C1 and the high flow rate range C2, is desired, the desired bypass flow rate B2 can be realized by any one of the opening of the on/off valve 32 and the opening degree adjustment of the flow rate control valve 30. For convenience of description, the opening degree of the flow rate control valve 30 at which the bypass flow rate B2 is realized is called a "specific opening degree".

The bypass line 24 is configured such that the flow rate of the working gas flowing in the variable flow rate bypass 27 in a state where the flow rate control valve 30 is opened to the specific opening degree is equal to the flow rate of the working gas flowing in the fixed flow rate bypass 28 in a state where the on/off valve 32 is turned on.

In a case where a bypass flow rate B3 included in the high flow rate range C2 is desired, the desired bypass flow rate B3 can be realized by implementing the opening degree adjustment of the flow rate control valve 30 simultaneously with the opening of the on/off valve 32. In this case, the variable flow rate bypass 27 and the fixed flow rate bypass 28 are used together. The desired bypass flow rate B3 can be obtained through the sum of the flow rate of the working gas flowing in the variable flow rate bypass 27 and the flow rate of the working gas flowing in the fixed flow rate bypass 28.

Figure 3:
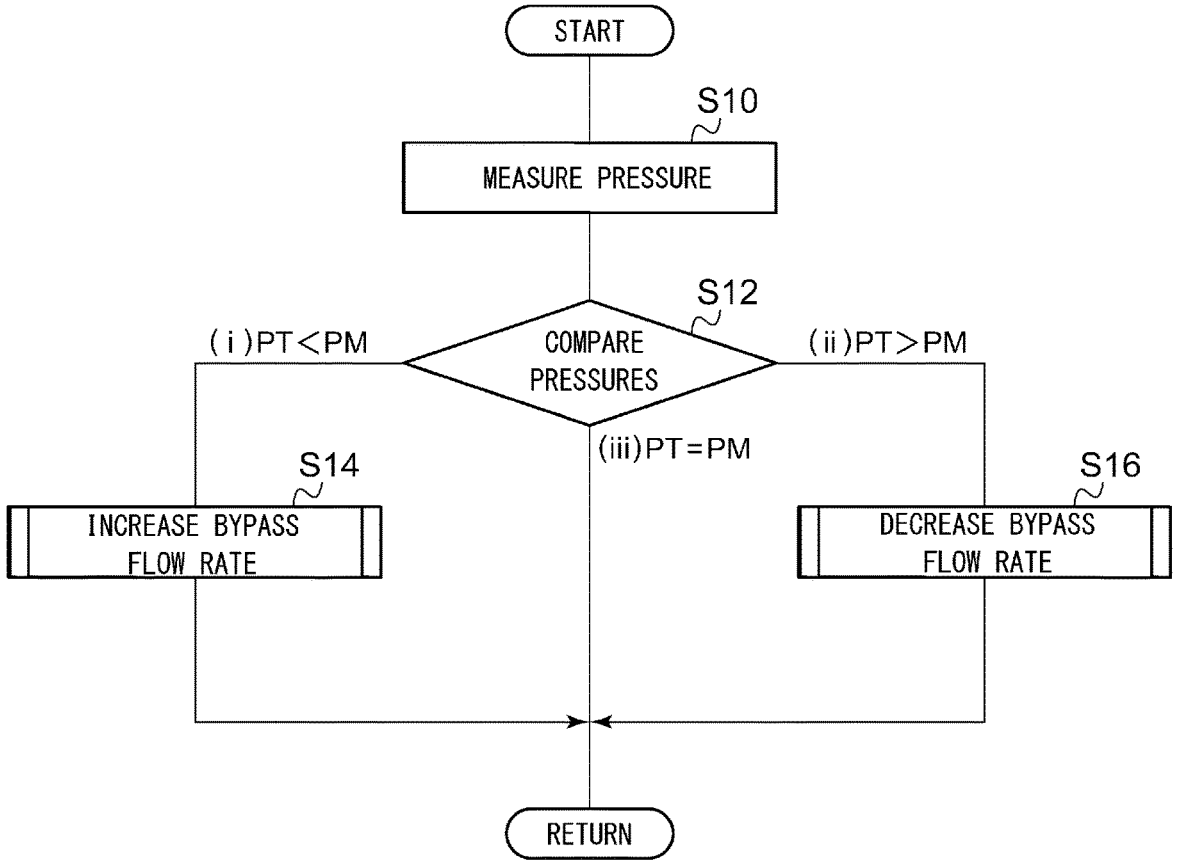
FIG. 3 is a flowchart showing a pressure controlling method for the cryocooler according to the one embodiment.

FIG. 3 is a flowchart showing a pressure controlling method for the cryocooler 10 according to the one embodiment. The bypass flow rate control unit 52 of the control device 50 is configured to execute a pressure control process for the gas line 34, which will be described below. The pressure control of the gas line 34 is repeatedly executed at a predetermined cycle during the operation of the cryocooler 10.

The pressure of the gas line 34 is measured (S10). The pressure of the gas line 34 is measured using a pressure sensor. The bypass flow rate control unit 52 acquires a measured pressure PM of the gas line 34 from the first measured pressure signal P1 and/or the second measured pressure signal P2.

Next, the measured pressure PM of the gas line 34 is compared with a target pressure PT (S12). The target pressure PT of the gas line 34 is input to the control device 50 in advance by a user of the cryocooler 10, or is automatically set by the control device 50 and is stored in the control device 50. The pressure comparison unit 54 compares the measured pressure PM with the target pressure PT and outputs a relationship as to which one of the measured pressure and the target pressure is larger or smaller as a comparison result. That is, the comparison result from the pressure comparison unit 54 indicates any one of the following three states. (i) The measured pressure PM is larger than the target pressure PT. (ii) The measured pressure PM is smaller than the target pressure PT. (iii) The measured pressure PM is equal to the target pressure PT.

A bypass flow rate increasing process (S14) or a bypass flow rate decreasing process (S16) is selected based on the comparison result from the pressure comparison unit 54, and the selected bypass flow rate control is executed. The opening degree instruction signal S1 and the on/off instruction signal S2 are generated as results of the bypass flow rate control, and the bypass flow rate control unit 52 outputs the signals to the flow rate control valve 30 and the on/off valve 32. Accordingly, the measured pressure PM of the gas line 34 is changed to become closer to the target pressure PT. In such a manner, the pressure control of the gas line 34 is provided and thereby the measured pressure PM of the gas line 34 can be made to follow the target pressure PT.

Specifically, (i) in a case where the measured pressure PM is larger than the target pressure PT, the valve control unit 56 executes the bypass flow rate increasing process (S14). (ii) In a case where the measured pressure PM is smaller than the target pressure PT, the valve control unit 56 executes the bypass flow rate decreasing process (S16). (iii) In a case where the measured pressure PM is equal to the target pressure PT, it is not necessary to increase or decrease the bypass flow rate, and thereby neither the bypass flow rate increasing process nor the bypass flow rate decreasing process is performed. Without changing the opening degree of the flow rate control valve 30 and the on/off state of the on/off valve 32, the bypass flow rate is maintained.

An example of the pressure control of the gas line 34 is high pressure control for keeping the pressure of the working gas in the high pressure line 35 at a target value. In a case where the high pressure control is executed, a measured value from the first pressure sensor 22 is used as the measured pressure PM. In a case where the measured pressure PM is larger (smaller) than the target pressure PT, the measured pressure PM can be made smaller (larger) to become closer to the target pressure PT by increasing (decreasing) the bypass flow rate.

Another example of the pressure control of the gas line 34 is differential pressure control for keeping a pressure difference between the high pressure line 35 and the low pressure line 36. In a case where the differential pressure control is executed, a differential pressure measured value obtained by subtracting the measured value of the second pressure sensor 23 from the measured value of the first pressure sensor 22 is used as the measured pressure PM. In a case where the measured pressure PM is larger (smaller) than the target pressure PT, the measured pressure PM can be made smaller (larger) to become closer to the target pressure PT by increasing (decreasing) the bypass flow rate.

It is also possible to execute low pressure control for keeping the pressure of the working gas in the low pressure line 36 at a target value as the pressure control of the gas line 34. The value measured from the second pressure sensor 23 is used as the measured pressure PM. However, contrary to the high pressure control, the bypass flow rate decreasing process is performed in a case where the measured pressure PM is larger than the target pressure PT, and the bypass flow rate increasing process is performed in a case where the measured pressure PM is smaller than the target pressure PT.

In the embodiment in which the compressor main body 25 is configured to discharge the working gas at a fixed and constant flow rate, the pressure controlling method using the bypass flow rate control shown in FIG. 3 may be executed at all times during the operation of the cryocooler 10.

In the embodiment in which the compressor main body 25 is configured to change a discharge flow rate of the working gas, the pressure controlling method using the bypass flow rate control shown in FIG. 3 may be executed only when the compressor main body 25 is being operated at a minimum discharge flow rate. The flow rate of the working gas to be supplied from the compressor 12 to the expander 14 can be controlled to be even lower than the minimum discharge flow rate in the compressor main body 25.

Figure 4:
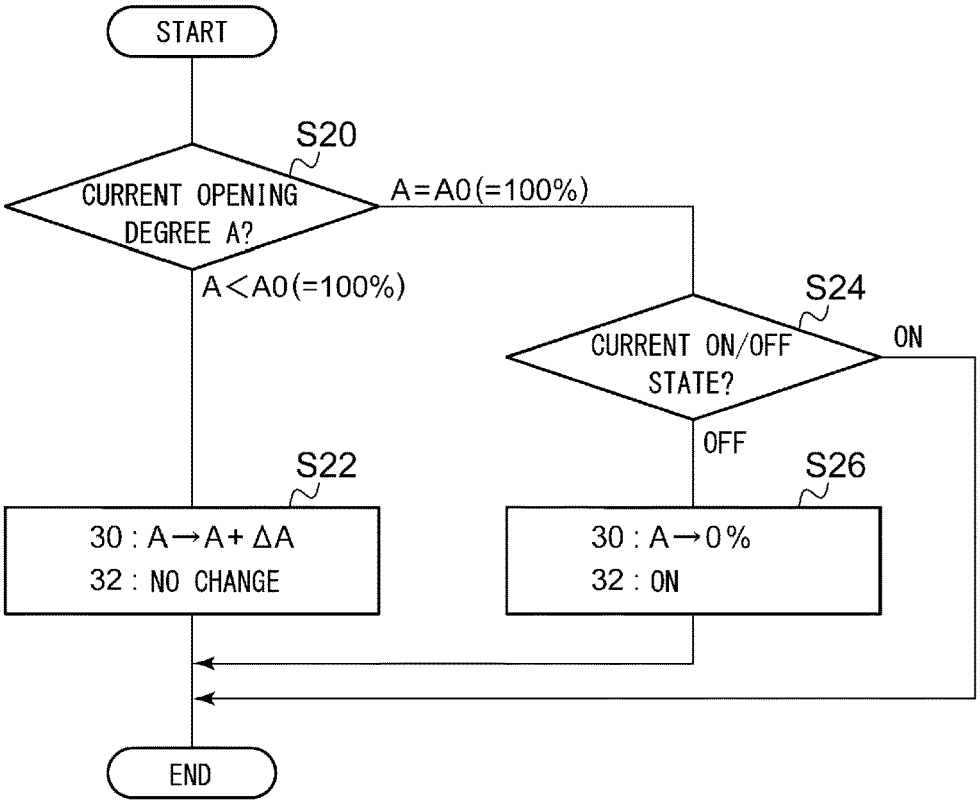
FIG. 4 is a flowchart describing a bypass flow rate increasing process shown in FIG. 3 according to the one embodiment.

FIG. 4 is a flowchart describing the bypass flow rate increasing process (S14) shown in FIG. 3 according to the one embodiment. First, the valve control unit 56 determines whether or not a current opening degree A of the flow rate control valve 30 is smaller than a specific opening degree A0 (S20). Herein, the specific opening degree A0 is set to an opening degree of 100%. For this reason, it is not necessary to consider a case where the current opening degree A exceeds the specific opening degree A0.

In a case where the current opening degree A of the flow rate control valve 30 is smaller than the specific opening degree A0 ("A<A0" in S20), the valve control unit 56 increases the opening degree of the flow rate control valve 30 (S22). An opening degree change amount ΔA is set in advance. In order to precisely control the bypass flow rate, it is desirable to make the opening degree change amount ΔA as small as possible. Thus, the opening degree change amount ΔA is set to, for example, 1%. The valve control unit 56 does not change the on/off state of the on/off valve 32. Therefore, the valve control unit 56 determines the opening degree instruction signal S1 such that the opening degree of the flow rate control valve 30 is added to the current opening degree A by the opening degree change amount ΔA, and determines the on/off instruction signal S2 such that the current on/off state of the on/off valve 32 is maintained.

In a case where the current opening degree A of the flow rate control valve 30 is equal to the specific opening degree A0 ("A=A0" in S20), the valve control unit 56 further determines the current on/off state of the on/off valve 32 (S24). In a case where the on/off valve 32 is turned off (off in S24), the valve control unit 56 determines the opening degree instruction signal S1 to change the opening degree of the flow rate control valve 30 to 0%, and determines the on/off instruction signal S2 to switch the on/off valve 32 to on (S26). As described above, since the flow rate of the working gas flowing in the variable flow rate bypass 27 in a state where the flow rate control valve 30 is opened to the specific opening degree is equal to the flow rate of the working gas flowing in the fixed flow rate bypass 28 in a state where the on/off valve 32 is turned on, the bypass flow rate does not change. In such a manner, the low flow rate range C1 shown in FIG. 2 can be switched to the high flow rate range C2.

In a case where the current opening degree A of the flow rate control valve 30 is equal to the specific opening degree A0 (=100%) and the on/off valve 32 is turned on (on in S24), both of the flow rate control valve 30 and the on/off valve 32 are completely opened, and the bypass flow rate cannot be increased any further. Accordingly, the valve control unit 56 maintains the current state of each of the flow rate control valve 30 and the on/off valve 32.

In such a manner, the bypass flow rate control unit 52 can increase the bypass flow rate in accordance with the flow rate distribution shown in FIG. 2.

Figure 5:
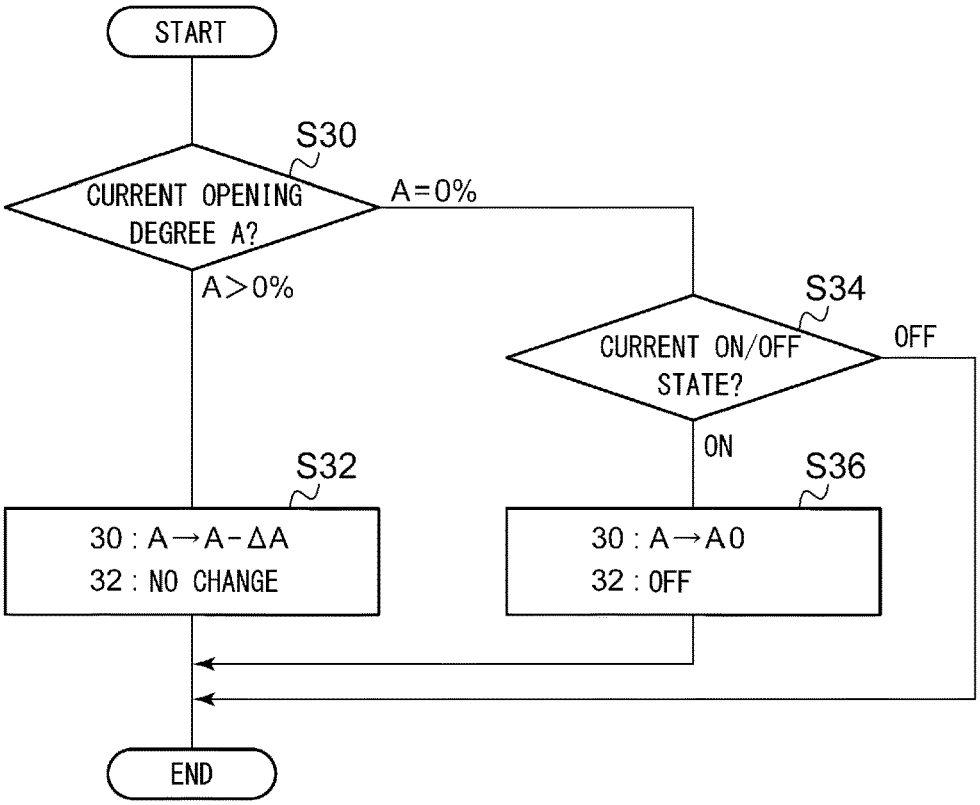
FIG. 5 is a flowchart describing a bypass flow rate decreasing process shown in FIG. 3 according to the one embodiment.

FIG. 5 is a flowchart describing the bypass flow rate decreasing process (S16) shown in FIG. 3 according to the one embodiment. First, the valve control unit 56 determines whether or not the current opening degree A of the flow rate control valve 30 is larger than 0% (S30). In a case where the current opening degree A of the flow rate control valve 30 is larger than 0% ("A>0%" in S30), the valve control unit 56 decreases the opening degree of the flow rate control valve 30 by the opening degree change amount ΔA (S32). The valve control unit 56 does not change the on/off state of the on/off valve 32. The valve control unit 56 determines the opening degree instruction signal S1 such that the opening degree of the flow rate control valve 30 is obtained by subtracting the opening degree change amount ΔA from the current opening degree A, and determines the on/off instruction signal S2 such that the current on/off state of the on/off valve 32 is maintained.

In a case where the current opening degree A of the flow rate control valve 30 is 0% ("A=0%" in S30), the valve control unit 56 further determines the current on/off state of the on/off valve 32 (S34). In a case where the on/off valve 32 is turned on (on in S34), the valve control unit 56 determines the opening degree instruction signal S1 to change the opening degree of the flow rate control valve 30 to the specific opening degree A0, and determines the on/off instruction signal S2 to switch the on/off valve 32 to off (S36). In such a manner, the high flow rate range C2 shown in FIG. 2 can be switched to the low flow rate range C1.

In a case where the current opening degree A of the flow rate control valve 30 is 0% and the on/off valve 32 is turned off (off in S34), both of the flow rate control valve 30 and the on/off valve 32 are completely closed. The working gas does not flow in the bypass line 24. The valve control unit 56 maintains the current state of each of the flow rate control valve 30 and the on/off valve 32.

In such a manner, the bypass flow rate control unit 52 can decrease the bypass flow rate in accordance with the flow rate distribution shown in FIG. 2.

The flow rate of the working gas circulating in the gas line 34 differs depending on a cooling capacity of the cryocooler 10. In the cryocooler 10 designed to realize a large cooling capacity, the flow rate of the working gas circulating the compressor 12 and the expander 14 increases, and accordingly also the flow rate of the working gas in the bypass line 24 required for pressure control also increases. A large flow rate adjusting device may be required.

In a comparative example, the design of a large cryocooler having a single electric valve (that is, without a parallel electromagnetic valve), which is a flow rate adjusting device of the bypass line, will be considered. According to examination by the present inventor, an electric valve that realizes flow rate control which satisfies a desired large cooling capacity requires a considerably large drive current. This leads to an increase in power consumption. Not only the increase in power consumption is caused, but also an electrical component attached to the electric valve is required to have high required specifications as the drive current increases. As a result, it is determined that avoiding a significant increase in the size of an entire electric valve device obtained by combining the electric valve with the electrical component is impossible.

In the cryocooler 10 according to the one embodiment, the bypass flow rate control unit 52 controls the flow rate of the working gas flowing in the bypass line 24 through a combination of the opening degree adjustment of the flow rate control valve 30 and the switching of the on/off valve 32.

Accordingly, inconvenience in the comparative example can be overcome. Since the bypass flow rate is distributed to a plurality of flow rate adjusting devices, the flow rate of each device is low. Accordingly, a relatively small device can be adopted. According to examination by the present inventor, the bypass line 24 of the large cryocooler can be designed by disposing the small flow rate control valve 30 and the small on/off valve 32, which are suitable for pressure control of the small cryocooler, in parallel with each other. Such a combination of the flow rate control valve 30 and the on/off valve 32 can be made into a compact size compared with the large electric valve device assumed in the comparative example. Therefore, an increase in the size of the flow rate adjusting device that can be used in the relatively large cryocooler 10 can be suppressed.

In addition, in the cryocooler 10 according to the one embodiment, the bypass flow rate control unit 52 includes the pressure comparison unit 54 that compares the measured pressure of the gas line 34 with the target pressure and the valve control unit 56 that controls the flow rate control valve 30 and the on/off valve 32 based on a comparison result from the pressure comparison unit 54, the opening degree of the flow rate control valve 30, and the on/off state of the on/off valve 32. By doing so, the pressure control of the gas line 34 can be provided as a relatively simple control process, and mounting becomes easy.

The bypass line 24 is configured such that the flow rate of the working gas flowing in the variable flow rate bypass 27 in a state where the flow rate control valve 30 is opened to the specific opening degree is equal to the flow rate of the working gas flowing in the fixed flow rate bypass 28 in a state where the on/off valve 32 is turned on. The valve control unit 56 controls the flow rate control valve 30 and the on/off valve 32 in accordance with (a) to (d) below.

(a) When the opening degree of the flow rate control valve 30 is smaller than the specific opening degree in a case where the measured pressure of the gas line 34 is larger than the target pressure, the valve control unit 56 determines the opening degree of the flow rate control valve 30 and the on/off state of the on/off valve 32 such that the opening degree of the flow rate control valve 30 increases by a predetermined amount with the specific opening degree as an upper limit without switching between on and off states of the on/off valve 32.

(b) When the flow rate control valve 30 is opened to the specific opening degree and the on/off valve 32 is turned off in a case where the measured pressure of the gas line 34 is larger than the target pressure, the valve control unit 56 determines the opening degree of the flow rate control valve 30 and the on/off state of the on/off valve 32 such that the on/off valve 32 is switched to on and the opening degree of the flow rate control valve 30 is set to 0%.

(c) When the opening degree of the flow rate control valve 30 is larger than 0% in a case where the measured pressure of the gas line 34 is smaller than the target pressure, the valve control unit 56 determines the opening degree of the flow rate control valve 30 and the on/off state of the on/off valve 32 such that the opening degree of the flow rate control valve 30 decreases by the predetermined amount without switching between on and off states of the on/off valve 32.

(d) When the opening degree of the flow rate control valve 30 is 0% and the on/off valve 32 is turned on in a case where the measured pressure of the gas line 34 is smaller than the target pressure, the valve control unit 56 determines the opening degree of the flow rate control valve 30 and the on/off state of the on/off valve 32 such that the on/off valve 32 is switched to off and the flow rate control valve 30 is opened to the specific opening degree.

By doing so, the bypass flow rate can be precisely adjusted and the low flow rate range C1 and the high flow rate range C2 can be smoothly switched. Accordingly, the pressure control of the gas line 34 suitable for practical use can be provided.

The specific opening degree is an opening degree of 100%. By doing so, the flow rate of the variable flow rate bypass 27 when the flow rate control valve 30 is fully open is equal to the flow rate of the fixed flow rate bypass 28 when the on/off valve 32 is open. This also helps simplifying a control configuration.

The pressure comparison unit 54 may compare the measured pressure of the high pressure line 35 with the target pressure. By doing so, the high pressure control of the gas line 34 can be provided. The pressure comparison unit 54 may compare a measured differential pressure between the high pressure line 35 and the low pressure line 36 with the target pressure. By doing so, the differential pressure control of the gas line 34 can be provided.

The flow rate control valve 30 is an electric valve. The on/off valve 32 is an electromagnetic valve. By using such a general-purpose product, the bypass line 24 can be configured at low costs. The flow rate adjusting device provided in the bypass line 24 is not limited thereto, and may be an electrically driven valve or a valve capable of adjusting the flow rate through other driving systems.

As described with reference to FIG. 6, it is not essential that the specific opening degree is 100%. The specific opening degree may be a randomly selected opening degree less than 100%.

Figure 6:
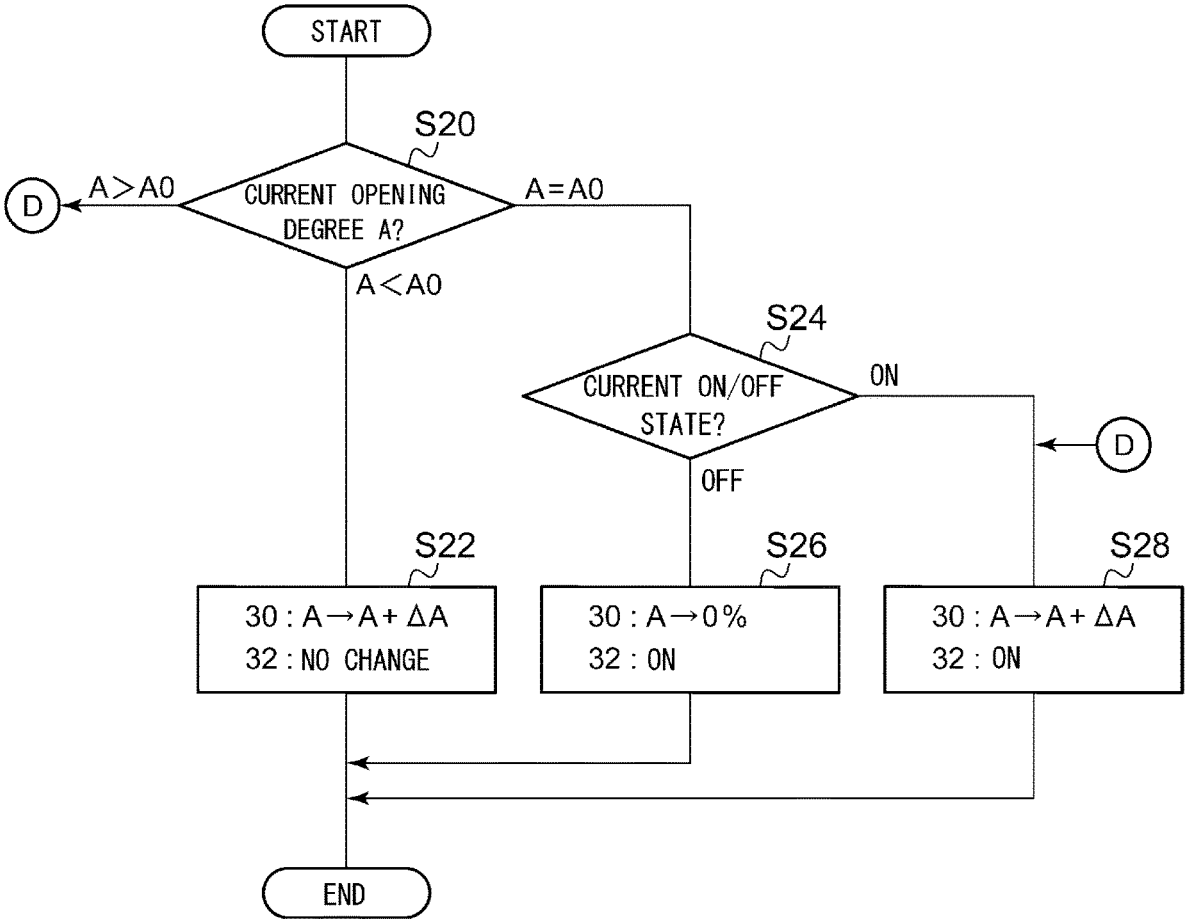
FIG. 6 is a flowchart describing another example of the bypass flow rate increasing process shown in FIG. 3.

FIG. 6 is a flowchart describing another example of the bypass flow rate increasing process (S14) shown in FIG. 3. A bypass flow rate controlling process shown in FIG. 6 is different from the bypass flow rate controlling process shown in FIG. 4 in that the specific opening degree A0 is less than 100%, but the rest is the same. Specifically, the process shown in FIG. 6 is the same as the process shown in FIG. 4 except "on in S24". Accordingly, the description of the same process will be omitted.

For example, a case where the specific opening degree A0 is 70% will be considered. In the bypass flow rate increasing process, the opening degree of the flow rate control valve 30 is increased from 0% to 70% in the low flow rate range C1. When the opening degree of the flow rate control valve 30 reaches 70% ("A=A0" in S20), the flow rate control valve 30 is closed and the on/off valve 32 is switched from off to on (S26), and transitions from the low flow rate range C1 to the high flow rate range C2.

As shown in FIG. 6, when the flow rate control valve 30 is opened to the specific opening degree A0 and the on/off valve 32 is turned on (on in S24) in a case where the measured pressure of the gas line 34 is larger than the target pressure, the valve control unit 56 determines the opening degree of the flow rate control valve 30 and the on/off state of the on/off valve 32 (S28) such that the opening degree A of the flow rate control valve 30 increases by a predetermined amount (that is, the opening degree change amount ΔA) without switching between on and off states of the on/off valve 32. In addition, in a case where the opening degree of the flow rate control valve 30 exceeds the specific opening degree A0 ("A>A0" in S20), the opening degree A of the flow rate control valve 30 may be changed by the predetermined amount (that is, the opening degree change amount ΔA) without switching between on and off states of the on/off valve 32 (S28). In the high flow rate range C2, since the on/off valve 32 is already open, it is not necessary to limit the opening degree of the flow rate control valve 30 to 70% or less. In a situation where a higher bypass flow rate is desired, the flow rate control valve 30 may be adjusted to an opening degree exceeding 70%. In such a manner, a control range of the bypass flow rate can be increased.

Figure 7:
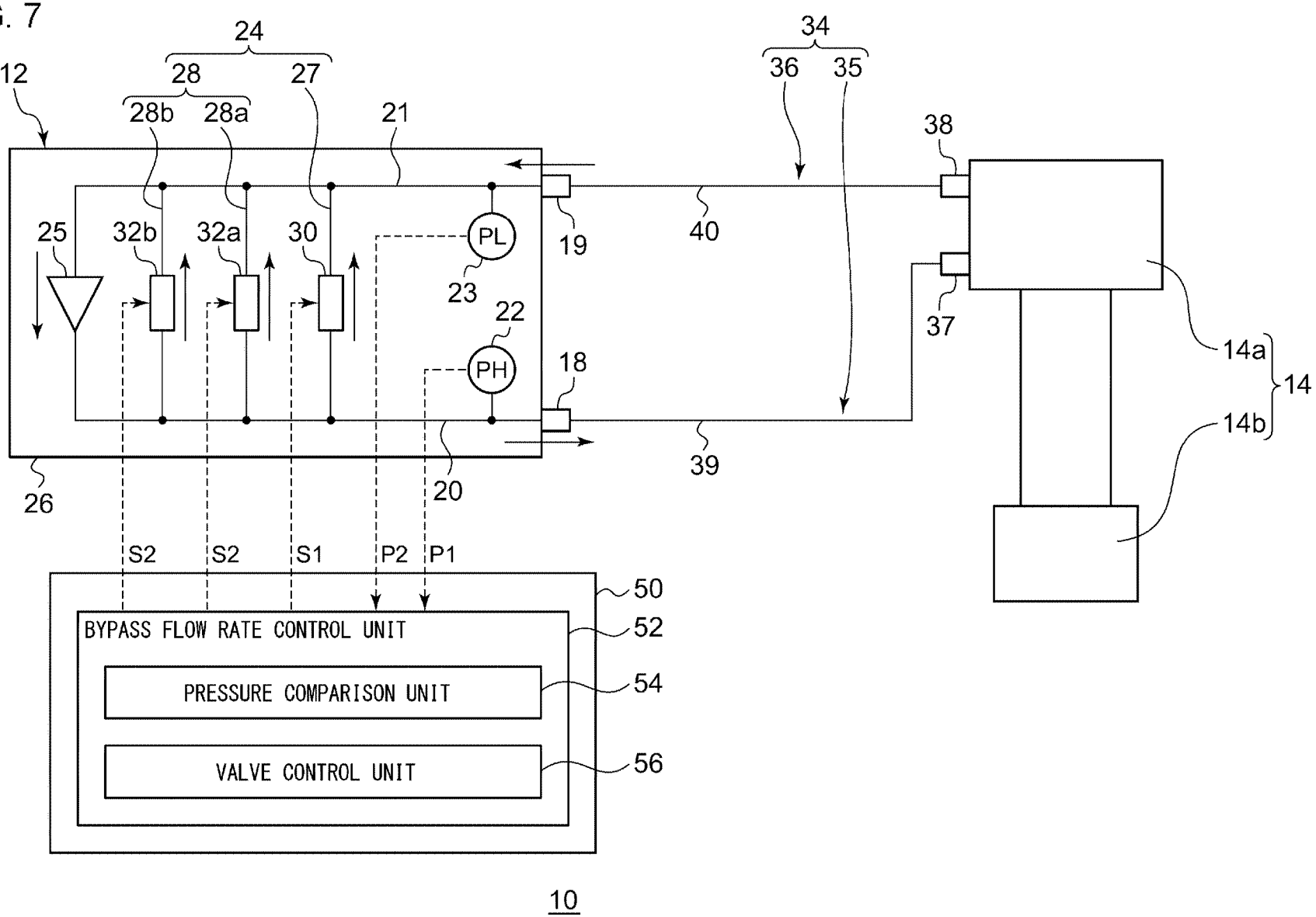
FIG. 7 is a diagram schematically showing a cryocooler according to another embodiment.

FIG. 7 is a diagram schematically showing the cryocooler 10 according to another embodiment. The cryocooler 10 according to another embodiment is the same as the cryocooler 10 according to the one embodiment except that the cryocooler 10 according to another embodiment has a plurality of on/off valves in parallel. Hereinafter, different configurations of the cryocoolers will be mainly described, and configurations common to the cryocoolers will be briefly described or description thereof will be omitted.

The fixed flow rate bypass 28 includes a plurality of sub-bypasses that connect the high pressure line 35 to the low pressure line 36 in parallel with the variable flow rate bypass 27. For example, the fixed flow rate bypass 28 has a first sub-bypass 28*a* and a second sub-bypass 28*b*. The number of sub-bypasses is not particularly limited, and three or more sub-bypasses may be provided. Each of the plurality of sub-bypasses includes an on/off valve. Accordingly, a first on/off valve 32*a* is disposed in the first sub-bypass 28*a*, and a second on/off valve 32*b* is disposed in the second sub-bypass 28*b*.

Figure 8:
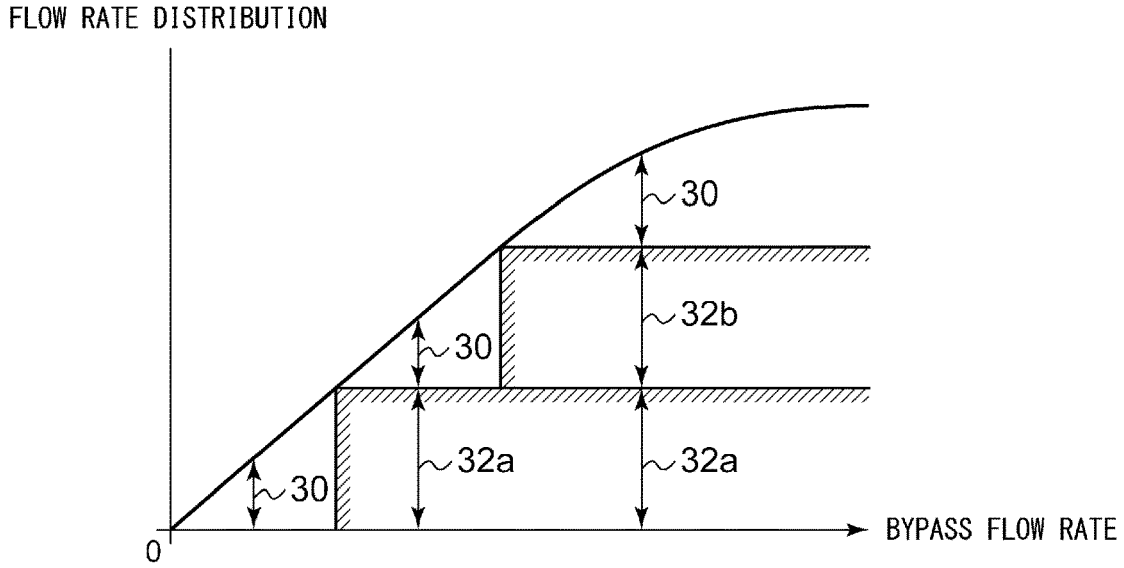
FIG. 8 is a conceptual diagram for describing flow rate distribution in a bypass line according to another embodiment.

FIG. 8 is a conceptual diagram for describing flow rate distribution in the bypass line 24 according to another embodiment. In a case where the desired bypass flow rate is low, both of the first on/off valve 32*a* and the second on/off valve 32*b* are turned off, and in a case where the desired bypass flow rate is high, the first on/off valve 32*a* is turned on and the second on/off valve 32*b* is turned off. In a case where the desired bypass flow rate is even higher, both of the first on/off valve 32*a* and the second on/off valve 32*b* are turned on. The opening degree of the flow rate control valve 30 is controlled depending on the desired bypass flow rate regardless of the level of the desired bypass flow rate.

The pressure controlling method shown in FIG. 3 can also be applied to the cryocooler 10 according to another embodiment as in the one embodiment.

Figure 9:
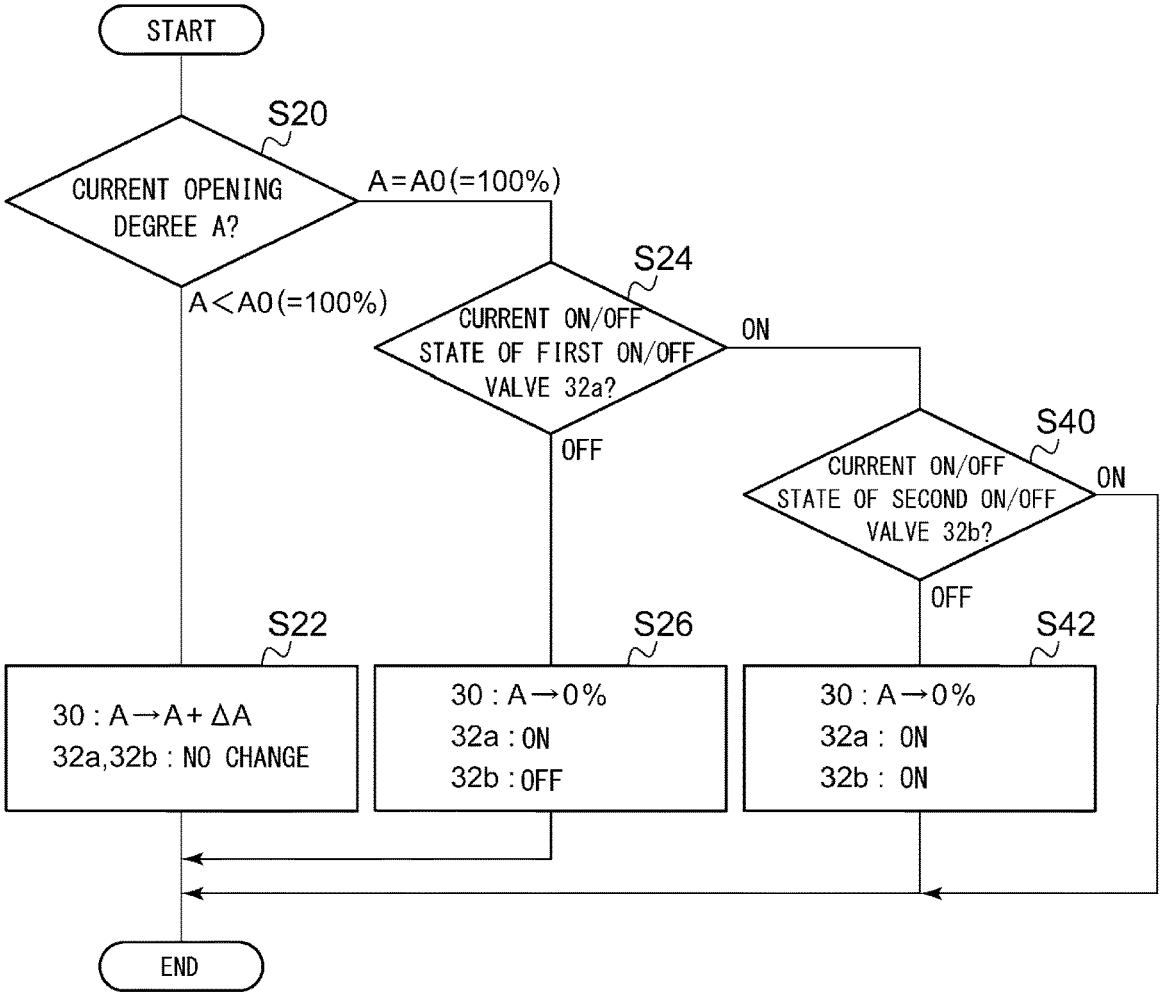
FIG. 9 is a flowchart describing a bypass flow rate increasing process according to another embodiment.

FIG. 9 is a flowchart describing the bypass flow rate increasing process (S14) shown in FIG. 3 according to another embodiment. The valve control unit 56 determines whether or not the current opening degree A of the flow rate control valve 30 is smaller than the specific opening degree A0 (S20). In a case where the current opening degree A of the flow rate control valve 30 is smaller than the specific opening degree A0 ("A<A0" in S20), the valve control unit 56 increases the opening degree of the flow rate control valve 30 by the opening degree change amount ΔA (S22). The valve control unit 56 does not change the on/off state of each of the first on/off valve 32*a* and the second on/off valve 32*b*.

In a case where the current opening degree A of the flow rate control valve 30 is equal to the specific opening degree A0 ("A=A0" in S20), the valve control unit 56 determines the current on/off state of the first on/off valve 32*a* (S24). In a case where the first on/off valve 32*a* is turned off (off in S24), the valve control unit 56 changes the opening degree of the flow rate control valve 30 to 0%, and switches the first on/off valve 32*a* to on (S26). The second on/off valve 32*b* remains off.

In a case where the first on/off valve 32*a* is turned on (on in S24), the valve control unit 56 further determines the current on/off state of the second on/off valve 32*b* (S40). In a case where the second on/off valve 32*b* is turned off (off in S40), the valve control unit 56 changes the opening degree of the flow rate control valve 30 to 0%, and switches the second on/off valve 32*b* to on (S42). The first on/off valve 32*a* remains on. In a case where both of the first on/off valve 32*a* and the second on/off valve 32*b* are on (on in S40), the valve control unit 56 maintains the current state of each of the flow rate control valve 30, the first on/off valve 32*a*, and the second on/off valve 32*b*.

Figure 10:
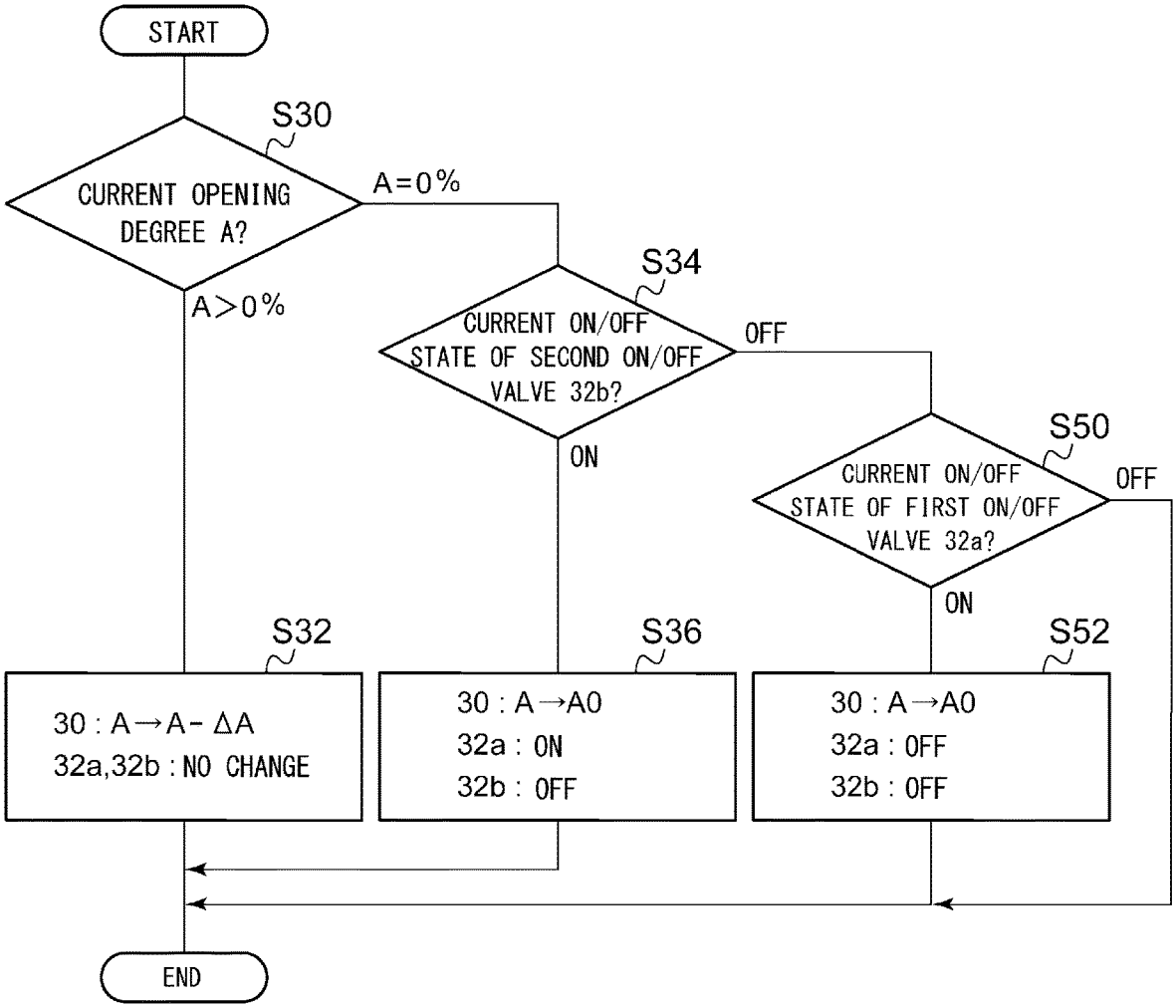
FIG. 10 is a flowchart describing a bypass flow rate decreasing process according to another embodiment.

FIG. 10 is a flowchart describing the bypass flow rate decreasing process (S16) shown in FIG. 3 according to another embodiment. The valve control unit 56 determines whether or not the current opening degree A of the flow rate control valve 30 is larger than 0% (S30). In a case where the current opening degree A of the flow rate control valve 30 is larger than 0% ("A>0%" in S30), the valve control unit 56 decreases the opening degree of the flow rate control valve 30 by the opening degree change amount ΔA (S32). The valve control unit 56 does not change the on/off state of each of the first on/off valve 32*a* and the second on/off valve 32*b*.

In a case where the current opening degree A of the flow rate control valve 30 is 0% ("A=0%" in S30), the valve control unit 56 determines the current on/off state of the second on/off valve 32*b* (S34). In a case where the second on/off valve 32*b* is turned on (on in S34), the valve control unit 56 changes the opening degree of the flow rate control valve 30 to the specific opening degree A0, and switches the second on/off valve 32*b* to off (S36). The first on/off valve 32*a* remains on.

In a case where the second on/off valve 32*b* is turned off (off in S34), the valve control unit 56 further determines the current on/off state of the first on/off valve 32*a* (S50). In a case where the first on/off valve 32*a* is turned on (on in S50), the valve control unit 56 changes the opening degree of the flow rate control valve 30 to the specific opening degree A0, and switches the first on/off valve 32*a* to off (S52). The second on/off valve 32*b* remains off. In a case where both of the first on/off valve 32*a* and the second on/off valve 32*b* are off (off in S50), the valve control unit 56 maintains the current state of each of the flow rate control valve 30, the first on/off valve 32*a*, and the second on/off valve 32*b*.

In such a manner, the bypass flow rate control unit 52 can increase or decrease the bypass flow rate in accordance with the flow rate distribution shown in FIG. 8. In the cryocooler 10 according to another embodiment, the control range of the bypass flow rate can be further increased.

In addition, unlike the one embodiment having the single fixed flow rate bypass 28, the fixed flow rate bypass 28 has a plurality of sub-bypasses, each of which includes an on/off valve, in the cryocooler 10 according to another embodiment. Since a larger number of bypass valves are provided in parallel, the flow rate of the working gas passing through each of the valves can be further decreased. Accordingly, a smaller flow rate adjusting device can be adopted.

Similar to the one embodiment, also in another embodiment, the specific opening degree is not limited to 100% and may be a randomly selected opening degree.

Figure 11:
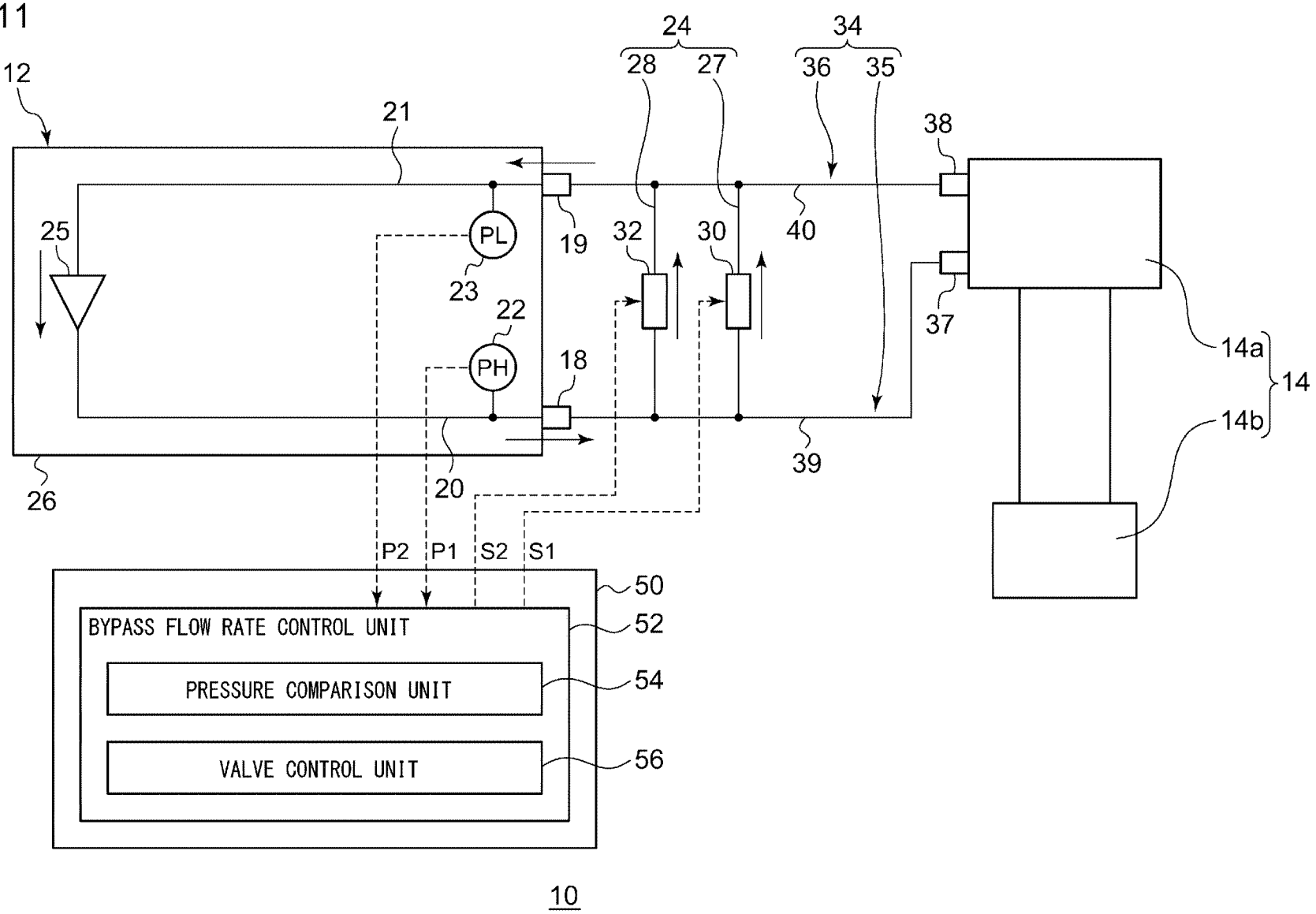
FIG. 11 is a diagram schematically showing a cryocooler according to still another embodiment.

FIG. 11 is a diagram schematically showing the cryocooler 10 according to still another embodiment. The cryocooler 10 according to still another embodiment is the same as the cryocooler 10 according to the one embodiment except for the disposition of the bypass line 24. Hereinafter, different configurations of the cryocoolers will be mainly described, and configurations common to the cryocoolers will be briefly described or description thereof will be omitted.

As shown in FIG. 11, the bypass line 24 may be disposed outside the compressor 12. The bypass line 24 connects the high-pressure pipe 39 to the low-pressure pipe 40 such that the working gas bypasses the expander 14 and returns from the high-pressure pipe 39 to the low-pressure pipe 40. The variable flow rate bypass 27 includes the flow rate control valve 30 and connects the high-pressure pipe 39 to the low-pressure pipe 40. The fixed flow rate bypass 28 includes the on/off valve 32, and connects the high-pressure pipe 39 to the low-pressure pipe 40 in parallel with the variable flow rate bypass 27.

Even in such a case, the cryocooler 10 can be configured as in the embodiments described above.

Also in still another embodiment, the plurality of on/off valves 32 may be provided and disposed in parallel. The first pressure sensor 22 and the second pressure sensor 23 may also be disposed outside the compressor 12. The first pressure sensor 22 may be disposed in the high-pressure pipe 39 to measure the pressure of the high-pressure pipe 39. The second pressure sensor 23 may be disposed in the low-pressure pipe 40 to measure the pressure of the low-pressure pipe 40.

The present invention has been described hereinbefore based on the embodiments. It is clear for those skilled in the art that the present invention is not limited to the embodiments, various design changes are possible, various modification examples are possible, and such modification examples are also within the scope of the present invention.

Various characteristics described related to one embodiment are also applicable to other embodiments. A new embodiment generated through combination also has the effects of each of the combined embodiments.

It is possible to use the present invention in the field of cryocoolers.

It should be understood that the invention is not limited to the above-described embodiment, but may be modified into various forms on the basis of the spirit of the invention. Additionally, the modifications are included in the scope of the invention.

What is claimed is:

1. A cryocooler comprising:

a compressor;

an expander;

a gas line that allows a working gas to be circulated between the compressor and the expander and includes a high pressure line through which the working gas is supplied from the compressor to the expander, and a low pressure line through which the working gas is collected from the expander to the compressor;

a bypass line that connects the high pressure line to the low pressure line such that the working gas bypasses the expander and returns from the high pressure line to the low pressure line; and a bypass flow rate control unit that controls a flow rate of the working gas flowing in the bypass line to provide pressure control of the gas line, wherein the bypass line includes a variable flow rate bypass that includes a flow rate control valve and connects the high pressure line to the low pressure line, and a fixed flow rate bypass that includes an on/off valve and connects the high pressure line to the low pressure line in parallel with the variable flow rate bypass, and the bypass flow rate control unit controls the flow rate of the working gas flowing in the bypass line through a combination of opening degree adjustment of the flow rate control valve and switching of the on/off valve.

2. The cryocooler according to claim 1, wherein the bypass flow rate control unit includes a pressure comparison unit that compares a measured pressure of the gas line with a target pressure, and a valve control unit that controls the flow rate control valve and the on/off valve based on a comparison result from the pressure comparison unit, an opening degree of the flow rate control valve, and an on/off state of the on/off valve.

3. The cryocooler according to claim 2, wherein the bypass line is configured such that a flow rate of the working gas flowing in the variable flow rate bypass, in a state where the flow rate control valve is opened to a specific opening degree, is equal to a flow rate of the working gas flowing in the fixed flow rate bypass in a state where the on/off valve is turned on, wherein when the opening degree of the flow rate control valve is smaller than the specific opening degree in a case where the measured pressure of the gas line is larger than the target pressure, the valve control unit increases the opening degree of the flow rate control valve by a predetermined amount with the specific opening degree as an upper limit without switching between on and off states of the on/off valve, wherein when the flow rate control valve is opened to the specific opening degree and the on/off valve is turned off in a case where the measured pressure of the gas line is larger than the target pressure, the valve control unit switches the on/off valve to on and sets the opening degree of the flow rate control valve to 0%, wherein when the opening degree of the flow rate control valve is larger than 0% in a case where the measured pressure of the gas line is smaller than the target pressure, the valve control unit decreases the opening degree of the flow rate control valve by a predetermined amount without switching between the on and off states of the on/off valve, and wherein when the opening degree of the flow rate control valve is 0% and the on/off valve is turned on in a case where the measured pressure of the gas line is smaller than the target pressure, the valve control unit determines the opening degree of the flow rate control valve and the on/off state of the on/off valve such that the on/off valve is switched to off and the flow rate control valve is opened to the specific opening degree.

4. The cryocooler according to claim 3, wherein the specific opening degree is an opening degree of 100%.

5. The cryocooler according to claim 3, wherein the specific opening degree is an opening degree of less than 100%, and wherein when the flow rate control valve is opened to the specific opening degree and the on/off valve is turned on in a case where the measured pressure of the gas line is larger than the target pressure, the valve control unit determines the opening degree of the flow rate control valve and the on/off state of the on/off valve such that the opening degree of the flow rate control valve increases by the predetermined amount without switching between the on and off states of the on/off valve.

6. The cryocooler according to claim 2, wherein the pressure comparison unit compares a measured pressure of the high pressure line with the target pressure.

7. The cryocooler according to claim 2, wherein the pressure comparison unit compares a measured differential pressure between the high pressure line and the low pressure line with the target pressure.

8. The cryocooler according to claim 1, wherein the fixed flow rate bypass includes a plurality of sub-bypasses each including the on/off valve and connecting the high pressure line to the low pressure line in parallel with the variable flow rate bypass.

9. The cryocooler according to claim 1, wherein the flow rate control valve is an electric valve, and the on/off valve is an electromagnetic valve.

* * * * *